US007815387B2

(12) United States Patent
Gueret

(10) Patent No.: US 7,815,387 B2
(45) Date of Patent: Oct. 19, 2010

(54) DEVICE FOR APPLYING A PRODUCT

(75) Inventor: Jean-Louis H. Gueret, Paris (FR)

(73) Assignee: L'Oreal S.A., Paris (FR)

( * ) Notice: Subject to any disclaimer, the term of this patent is extended or adjusted under 35 U.S.C. 154(b) by 0 days.

(21) Appl. No.: 12/659,393

(22) Filed: Mar. 8, 2010

(65) Prior Publication Data

US 2010/0175704 A1 Jul. 15, 2010

Related U.S. Application Data

(62) Division of application No. 10/060,234, filed on Feb. 1, 2002, now abandoned.

(30) Foreign Application Priority Data

Feb. 1, 2001 (FR) ..... 01 01373

(51) Int. Cl.
*A45D 33/00* (2006.01)

(52) U.S. Cl. ..... 401/130

(58) Field of Classification Search ..... 401/25, 401/119, 125–127, 130, 261, 262, 269; 132/294–296, 132/301–304
See application file for complete search history.

(56) References Cited

U.S. PATENT DOCUMENTS 1,713,588 A * 5/1929 Younghusband ..... 401/130
1,911,691 A * 5/1933 Jacobson ..... 132/299
2,557,141 A * 6/1951 Rebora ..... 132/294

* cited by examiner

*Primary Examiner*—Huyen Le
(74) *Attorney, Agent, or Firm*—Finnegan, Henderson, Farabow, Garrett & Dunner, L.L.P.

(57) ABSTRACT

A device for applying a product may comprise a first portion and a second portion moveable with respect to the first portion so as to selectively place the device in one of a closed position and an open position. The first portion and the second portion may define a substantially closed reservoir when the device is in the closed position. The device may further comprise an application member. The application member may be at least partially compressible and configured such that, when the device is in the closed position, the application member is at least partially compressed inside the substantially closed reservoir and, when the device is moved from the closed position to the open position, the application member becomes substantially uncompressed. The application member may be configured so that when the application member is uncompressed, the application member is capable of being loaded with substantially all of an amount of product that the device is capable of containing.

30 Claims, 4 Drawing Sheets

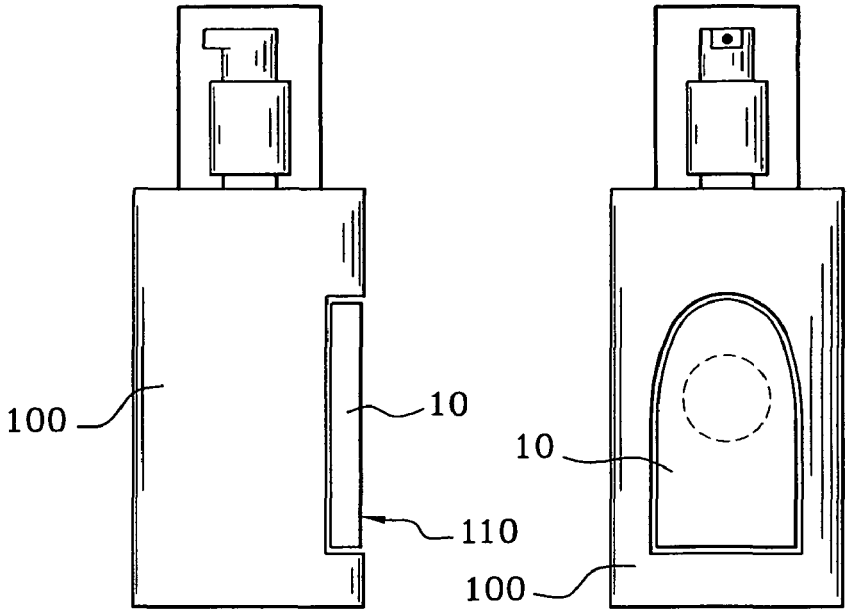
Fig. 2A
Fig. 2B
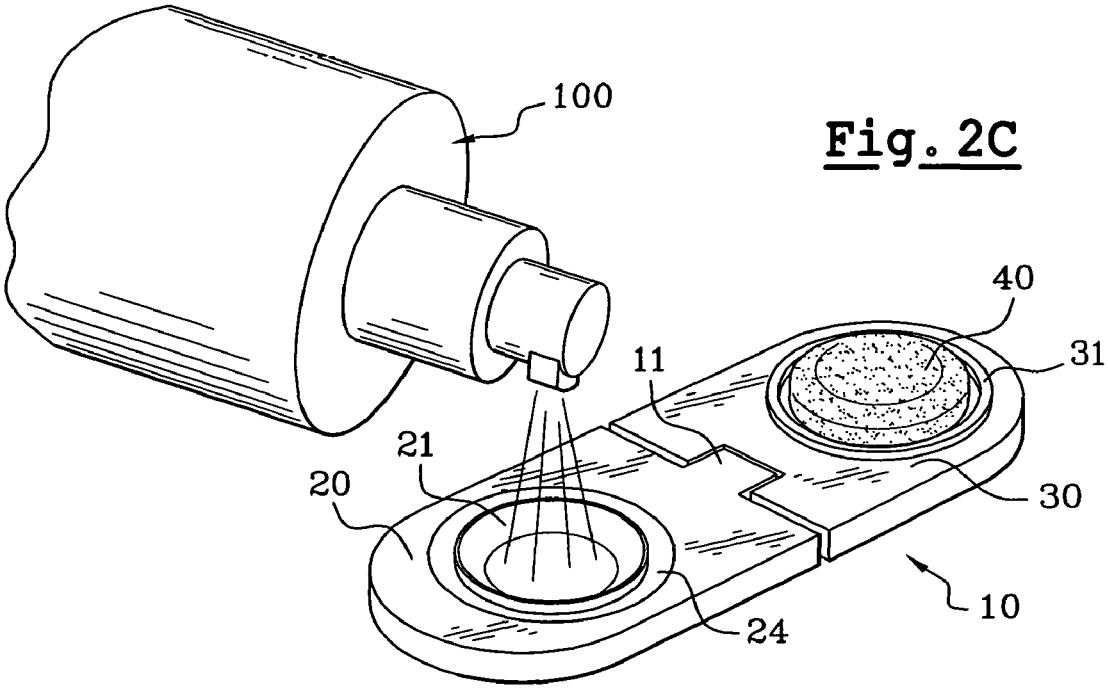
Fig. 2C

DEVICE FOR APPLYING A PRODUCT

This is a division of application Ser. No. 10/060,234, filed Feb. 1, 2002 now abandoned, which is incorporated herein by reference.

The present invention relates to devices for applying a product to a surface. In one aspect, the invention relates to a portable device for storing a relatively small amount of product (e.g., a cosmetic product, such as a make-up product and/or a care product) for example, intended for application.

In the field of cosmetics (which includes body care), products may be packaged in single doses. Such single dose packages may be used as samples intended to allow customers to test products. Such packages also may be relatively easy to carry in a handbag. In this way, a user may not have to carry around a larger bottle or other container containing a relatively large amount of product that may be bulky and not feasibly portable.

Tearable sachets containing liquids, creams, or the like, that are used, for example, for samples, already exist. However, opening such sachets may be difficult because the product tends to come out of the sachet while one is tearing it in order to open it. Furthermore, such packaging entails the use of the fingers to apply the product, something which may not always be desirable because, since this type of product may often be used outside of the bathroom, there may not be a facility for washing the hands after application.

Sachets containing wipes impregnated with liquid also exist. Such sachets may be easier to use as they generally may be easier to open given that the product is held in the wipe. However, the fingers again may come in contact with the product during application, for example, through holding the impregnated wipe.

It therefore may be desirable to produce a device for storing and applying a product which does not have the abovementioned drawbacks. For example, it may be desirable to provide a device that may be relatively nonbulky and readily portable.

It also may be desirable to provide a refillable device, for packaging a product intended for application.

Yet another desirable aspect may be a device that may permit the product to be applied in a practical way including, for example, a device that may be easy to hold while also deforming enough to make the product easy to apply while avoiding dirtying a user's fingers.

It should be understood that the invention could be practiced without performing one or more of the aspects described above. Other aspects will become apparent from the detailed description which follows. As embodied and broadly described herein, the invention includes a device for applying a product that may comprise a first portion and a second portion moveable with respect to the first portion so as to selectively place the device in one of a closed position and an open position. The first portion and the second portion may define a substantially closed reservoir when the device is in the closed position. The device may further comprise an application member that may be at least partially compressible and configured such that, when the device is in the closed position, the application member is at least partially compressed inside the substantially closed reservoir and, when the device is moved from the closed position to the open position, the application member becomes substantially uncompressed. The application member may be configured so that when the application member is uncompressed, the application member is capable of being loaded with substantially all of an amount of product that the device is capable of containing. In an exemplary embodiment, the application member may be attached to the second portion.

In another aspect, a device for applying a product may comprise a first portion comprising an impermeable surface and a second portion moveable with respect to the first portion so as to selectively place the device in one of a closed position and an open position. In the closed position, the first portion and the second portion may define a substantially closed reservoir configured to contain product intended for application to a surface. The device may further comprise an application member attached to the second portion. The application member may be at least partially compressible and configured to be in contact with the impermeable surface and at least partially compressed inside the substantially closed reservoir when the device is in the closed position.

According to yet another aspect, a device for applying a product may comprise a first portion comprising an impermeable surface and a second portion moveable with respect to the first portion so as to selectively place the device in one of a closed position and an open position. In the closed position, the first portion and the second portion may define a substantially closed reservoir. The device may further comprise an application member attached to the second portion. The application member may be at least partially compressible and configured such that, when the device is in the closed position, the application member is at least partially compressed inside the substantially closed reservoir. The reservoir may contain a layer of product intended to be applied to a surface and the layer of product may contact both the application member and the impermeable surface.

The term "impermeable surface" as used herein includes surfaces that are configured such that they do not permit flow of product to pass therethrough, even temporarily. For example, a surface that includes a valve that temporarily opens to permit flow therethrough would not, as used in the context of this application, constitute an impermeable surface. In another example, a surface having one or more openings passing therethrough to permit flow of product would not be an impermeable surface.

The term "layer of product" as used broadly herein may include product in a variety of forms, such as liquid, semi-liquid, pasty, semi-solid, and solid, for example. Moreover, it may include more than one substance either mixed together or a plurality of immiscible substances. The term also is intended to include product in the form of beads contacting one another.

In an exemplary embodiment, the application member may be configured to absorb at least some (e.g., all or a portion) of the product the reservoir is configured to contain. In yet another exemplary embodiment, the application member may be configured to absorb substantially all of the product the reservoir is configured to contain. The application member also may be configured to absorb at least some of the product the reservoir is configured to contain when the device is in the closed position, and may be further configured to absorb substantially any remaining product in the reservoir when the device is moved from the closed position to the open position. For example, the application member may be configured to absorb the remaining product via expansion of the application member from the at least partially compressed configuration to a substantially uncompressed configuration.

The application member may be attached to the second portion by at least one of bonding, welding and clipping. It is possible, for example, to bond the applicator onto the second part using an adhesive composition or by melting material, or alternatively to weld it firmly, by ultrasound, or by high frequency welding. In an exemplary embodiment, the application member may comprise a compressible porous material. For example, the application member may be made of at least one of an open-cell foam, a semi-open-cell foam, a felt, and a frit. The application member may be made from a material chosen from polyurethanes, polyesters, polyethers, polyvinyl chlorides, and ethylene vinyl acetates. It is also possible to use an applicator consisting of several different materials, particularly a stack of foams of different natures and/or different densities. The application member also may be flocked. The application member may also be made of a material capable of absorbing the product, for example of cotton, and may be covered with a film of elastomer at least partially perforated to allow the product to pass.

The porous material may be hydrophilic, lipophilic, or the like. According to another exemplary embodiment, the application member may comprise an additive capable of absorbing at least one of water and oil. A silica or an alginate may, for example, be chosen. In this way, the application member may be saturated with product without this product tending to run out of the application member. It thus may be possible to dispense with additional means on either the first portion or the second portion for sealing the device and controlling the rate at which the product leaves during application. The applicator may also contain preservatives which preserve the product present inside it. The application member also may comprise a preservative. The application member also may be at least partially absorbent.

The first portion may define a recess, and the substantially closed reservoir may comprise the recess and at least a part of the second portion. The first portion may comprise a housing portion defining the recess.

In an exemplary embodiment, the first portion may comprise at least one of a metallic material, a metalloplastic complex, and a thermoplastic material.

The metallic material may comprise aluminum, for example. The thermoplastic material may be chosen from polyethylenes, polypropylenes, polyethylene terephthalates, polyvinyl chlorides, polyacrylates, and polyamides, for example.

The first portion may be made by one of pressing, thermoforming, and injection molding.

According to another exemplary embodiment, the second portion may be attached to the first portion. For example, the second portion may be clipped, screwed, and/or hinged to the first portion. The second portion may comprise a lid. The lid may be formed by molding a thermoplastic material, for example. The thermoplastic material may be chosen from polyethylenes, polypropylenes, polyethylene terephthalates, polyvinyl chlorides, and polyamides.

In yet another exemplary embodiment, the second portion may comprise a film seal formed of at least one layer of at least one of a thermoplastic material, a metallic material, and a metalloplastic complex. As an example, the thermoplastic material may be chosen from polyethylenes, polypropylenes, polyethylene terephthalates, and polyvinyl chlorides. The metallic material may be chosen from aluminums, aluminum alloys, and brasses. The film seal may have a flexibility such that it is configured to deform with the application member during application of product to a surface. Such a configuration may make the application of the product easier regardless of the area of the body (e.g., face) to which the user applies the product.

The film seal may be attached to the first portion by one of hot bonding, cold bonding, and welding. The bonding may be done using an adhesive composition, or by melting material. The welding may be thermal, ultrasonic or high frequency welding. To open such a device, the two welded or bonded parts may easily be detached by tearing, for example by peeling or alternatively by tearing an end off. The two parts may be completely detached or may remain partially attached, for example along a film hinge, after tearing. A device such as this may have an opening/closure system that may be relatively simple and economical to produce. The opening of the device according to an exemplary embodiment including the film seal may be irreversible, that is to say permanent, for example. In this way, a device may be intended, for example, for a single use.

In an exemplary embodiment, the film seal may be attached to the first portion by one of a line of welding and a line of adhesive that substantially continuously surrounds the application member. The device may thus be enclosed in a perfectly sealed way so as to correctly preserve the product present in the application member. This may allow it to be carried around without any risk of the product running out of the device.

The first portion and the second portion may each comprise a sheet. Each sheet may comprise at least one layer made of at least one of a thermoplastic material, a metallic material, and a metalloplastic complex. The thermoplastic material may be chosen from polyethylenes, polypropylenes, polyethylene terephthalates, and polyvinyl chlorides, for example. The metallic material may be chosen from aluminums, aluminum alloys, and brasses, for example. In an exemplary embodiment, the sheets may be superposed and attached together along their respective peripheral regions. The sheets may form a sachet. The device may be placed in the open position by separating the first portion and the second portion from one another. The two sheets may be formed of the same material or of differing materials.

A product may be contained in the device. For example, the product may be contained in the substantially closed reservoir when the device is in the closed position. The product may be chosen from a make-up product and a care product. As an example, the product may be a cosmetic product. The product may be intended for application to at least one of skin, hair, a fingernail, and a toenail. The product may comprise one of a liquid, a gel, a cream, and a powder.

According to another aspect, an application system comprises a plurality of any of the devices discussed above. The plurality of devices may be removably joined together. For example, they may be joined together by at least one frangible portion. Such an embodiment may permit the user to have several doses of product with their packaging and applicator device. These doses may be separated so that only the desired number of doses need be carried around.

Each of the plurality of devices may contain a product intended for application to a surface. Each of the plurality of devices may either contain differing products or substantially the same product.

According to yet another aspect, an application system comprises any of the devices discussed above and a container configured to contain a product intended to be disposed in the device. The container may be configured to contain an amount of product greater than the amount of product the device is capable of containing. Such a system may permit a user to have a reserve of product in the container that can be kept, for example in the bathroom, and to have a device for containing a relatively small dose of product and for applying it that can be taken away for the weekend, or other relatively short time period, for example.

In an exemplary embodiment, the device may be removably attachable to the container. The container may contain the product to be disposed in the device.

Yet another aspect includes a method for applying a product to a surface comprising providing any of the devices described herein, with the device containing a product intended to be applied to a surface. The method may further comprise moving the device from the closed position to the open position and placing the application member in contact with the surface so as to apply product to the surface.

The term "providing" is used broadly, and refers to, but is not limited to, making available for use, giving, supplying, obtaining, getting a hold of, acquiring, purchasing, selling, distributing, possessing, making ready for use, and/or placing in a position ready for use.

The placing of the application member in contact with the surface may comprise placing the application member in contact with one of hair, skin, a fingernail, and a toenail. In an exemplary embodiment, the placing of the application member in contact with the surface may comprise applying substantially all of the product loaded on the application member to the surface.

The method may further comprise at least partially filling the device with the product. The filling of the device with the product may be performed by other than a user of the device. Alternatively, the filling of the device with the product may be performed by the user of the device. The method also may comprise at least partially refilling the device with product after the applying of the product to the surface.

Having opened any of the devices described above, the user may apply the product by holding the part of the packaging device that is secured to the applicator without his or her fingers being in contact with the applicator, and potentially without the product dirtying the fingers.

Because the application member of the devices described above may be able both to contain practically all the product packaged in the device and to apply it, the bulk of the device may be limited by using a single element that fulfils two functions. An additional reservoir of product may not be needed. In addition, as the device may contain a relatively small amount of product, namely an amount of product allowing for example between one to five applications, use may be made of a small applicator so that a device may be produced that may have minimal bulk and may be readily portable.

Moreover, when the device is opened, relaxation (i.e., expansion) of the application member may take in substantially any remaining product present in the reservoir and substantially all of the product may therefore be loaded on the application, for example impregnated in the application member, so as to potentially minimize the risk of product running out of the device. The product may be pumped out mechanically and/or by capillarity and may, for example, lie in pores of the application member.

It is conceivable for additional accessories, for example a small mirror, or the like, to be arranged in device, for example, in the first portion near the housing portion.

Besides the structural and procedural arrangements set forth above, the invention could include a number of other arrangements, such as those explained hereinafter. It is to be understood that both the foregoing description and the following description are exemplary.

The accompanying drawings are included to provide a further understanding of the invention and are incorporated in and constitute a part of this specification. The drawings illustrate exemplary embodiments of the invention and, together with the description, serve to explain certain principles. In the drawings, FIG. 1A is a perspective view of an exemplary embodiment of a device for applying a product according to an aspect of the invention;

FIG. 2A is a perspective view of an exemplary embodiment of a system for applying a product according to an aspect of the invention;

FIG. 2B is another perspective view of the system of FIG. 2A;

FIG. 2C is a perspective view of yet another exemplary embodiment of a system for applying a product according to an aspect of the invention;

Figure 1A:
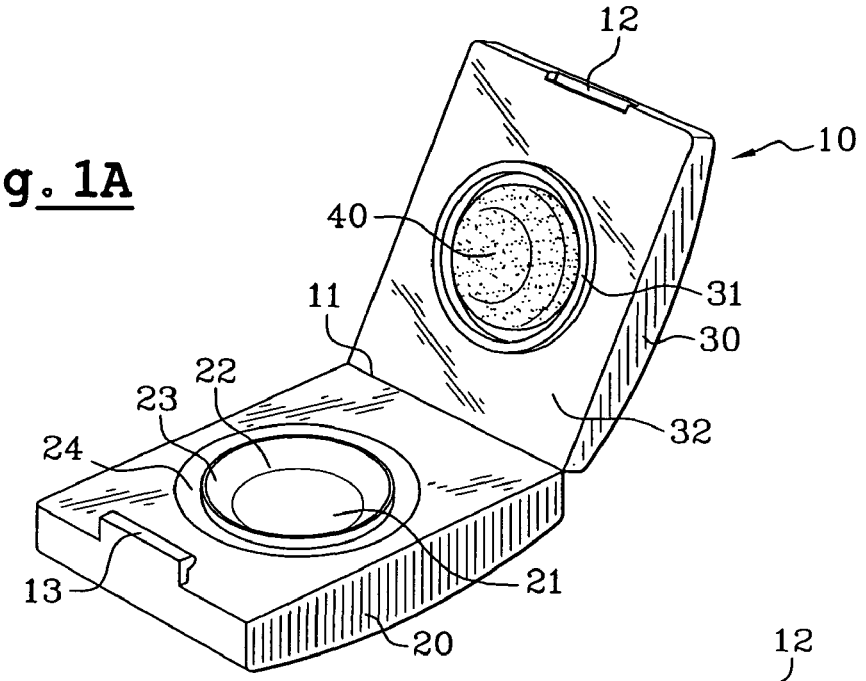
FIG. 1B is a side view of the exemplary embodiment of the device of FIG. 1A being filled with product from a container according to an aspect of the invention.
FIG. 1C is a side view of the exemplary embodiment of the device of FIG. 1B shown in a closed position.

Reference will now be made in detail to exemplary embodiments of the invention, examples of which are illustrated in the accompanying drawings. Wherever possible, the same reference numbers are used in the drawings and the description to refer to the same or like parts, and the same reference numbers with alphabetical suffixes are used to refer to similar parts.

Figure 1B:
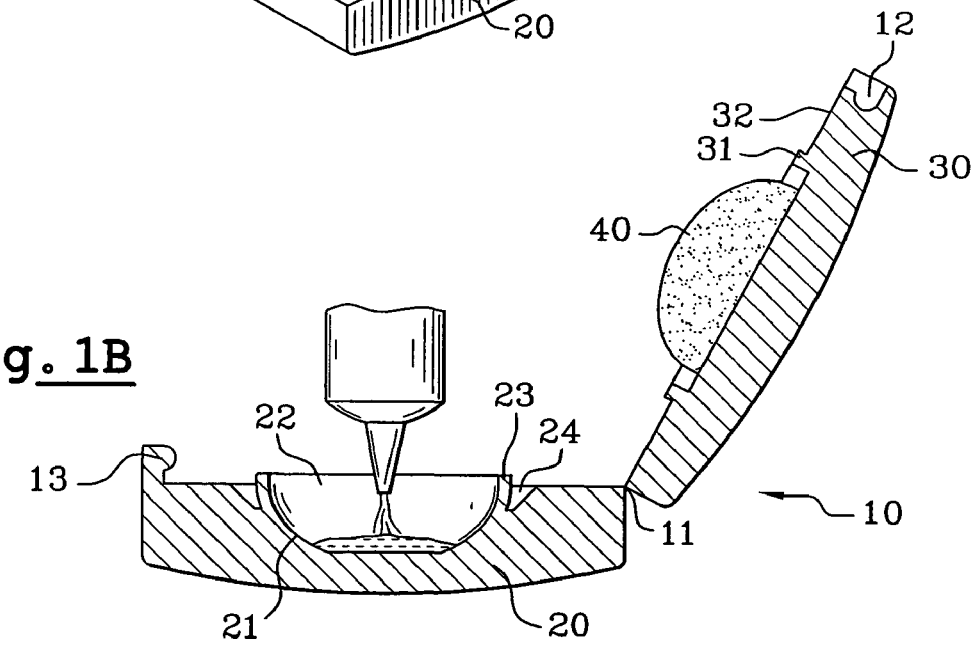
Figure 1C:
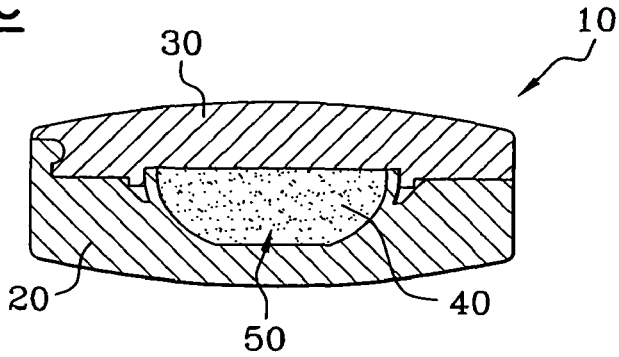

FIGS. 1A to 1C depict a device for storing a product to be applied to a surface according to an exemplary embodiment of the invention. The product may be a make-up product, a care product, and/or any other type of cosmetic product, for example. The device 10 may comprise a first portion 20 in the form of a base, for example. The first portion 20 may comprise a housing portion 21. The housing portion 21 may delimit an recess 22. A second portion 30, in the form of a lid, for example, may cover the recess 22 and seal it closed. In this manner, the lid 30 and housing portion 21 may define a substantially closed reservoir 50. The container 20 and the lid 30 may be connected via hinge 11. The hinge 11 may be of any type, such as, for example a film hinge, as shown. Two mutually cooperating clasp members 12, 13 may be provided respectively on the lid 30 and the base 20. These clasp members 12, 13 may, on the one hand, keep the device 10 in a closed position and, on the other hand, allow the device 10 to be opened so as to permit access to the recess 22. The device 10 also may comprise an accessory, such as a mirror disposed on one of the base 20 and the lid 30.

A foam application member 40 may be fixed to the interior wall of the lid 30, such as on to the wall designed to face the base 20, as shown in FIGS. 1A and 1B, for example. The foam application member 40 may comprise a block of foam which, for example, has the shape of a hemisphere having a diameter ranging from approximately 2 mm to approximately 30 mm, and/or from approximately 3 mm to approximately 20 mm, and/or from approximately 4 mm to approximately 50 mm. Its height in an uncompressed position may range from approximately 2 mm to approximately 30 mm.

The housing portion 21 may have a shape that more or less complements that of the application member 40. In an exemplary embodiment, the volume of the recess 22 defined by the housing 21 may be slightly smaller than the volume of the application member 40 when the foam is not compressed so that, when the device 10 is in the closed position, the foam is slightly compressed inside the recess 22, as can be seen in FIG. 1C. An annular wall 23 of the housing portion 21 may form a sealing neck 24 with the lid 30.

That is, an annular wall 31 may also be provided on the lid 30 around the application member 40 so that it is lodged in a neck 24 surrounding the annular wall 23 when the device 10 is in the closed position. The height of the annular wall 31 may be less than the height of the foam application member 40 when the device 10 is in the open position. This may permit the foam application member 40 to be placed in contact with the surface to which product is to be applied. The lid 30 may extend around the application member 40 so as to form a region 32 for a user to hold. This may allow the user to hold the device 10 in the open position without the user's fingers coming in contact with the product. The region 32 for holding may have an area that is large enough that it can be grasped by the user without being so large that the device formed would be too bulky.

When the device 10 is being manufactured, the base 20 and lid 30 may be formed first by injection molding. The film hinge 11 may be obtained for example, via a region of decreased thickness. The foam application member 40 may then be fixed to the lid 30 by bonding, for example, so as to obtain the structure depicted in FIG. 1A. The product is then introduced into the opening 22, as illustrated in FIG. 1B. In an exemplary embodiment, an amount of product corresponding to about five applications, for example, is introduced. The lid 30 may then be closed so that the foam application member 40 comes into contact with the product present in the recess 22 of the housing portion 21. The product may then be at least partially absorbed by the foam application member 40. The dose of product introduced may be such that it does not completely saturate the application member 40, but saturates about 90% thereof, for example. For example, a layer of product may be formed between the application member 40 and the impermeable surface of the housing portion 21 that defines the recess 22. (Alternatively or in addition, the application member 40 may contact that impermeable surface regardless of the amount of product.) In the closed position, the application member 40 may be slightly compressed in the substantially closed reservoir 50, as can be seen in FIG. 1C.

To use the device 10 to apply product, the user may open the lid 30, which may cause the foam application member to relax and expand. If any product remains in the bottom of the recess 22, it may be pumped out by the expansion of the foam at the time of opening the device. Practically all the product contained in the device 10 may therefore be loaded on (i.e., carried by) the application member 40. The user can then apply the product by holding the device 10, for example, by the region 32, and placing the application member 40 in contact with the surface to which the product is to be applied. Having used the application member 40 for a first time, the user may, if he or she so wishes, refill the device 10 with product. Specifically, after one use, product can be reintroduced into the recess 22, the lid 30 can be closed again so that the device 10 can be carried around, and product can be applied again by opening the device 10 and placing the application member 40 in contact with a surface. In an exemplary embodiment, a mark (not shown) may be provided in the housing portion 21 in order to indicate how much product to introduce into the housing portion 21.

It may be possible for the product to be introduced into the device by the user, before carrying it around, rather than at the time of manufacture. In that case, product may be introduced in the same way as it was when it was introduced during manufacture, but instead it will be introduced by the user.

The product may be a cream, a gel, a liquid, a paste, a solid, a semi-solid, or any other product form intended for direct application to a surface. Further, provision may also be made for the application member to contain a first product and for a second product contained in an independent container to be picked up prior to application. For example, the application member may contain water, or other suitable substance, and the user may pick up on the application member a product, for example, a friable product, such as a foundation, an eye shadow, etc. contained in a separate case.

FIGS. 2A to 2D depict an exemplary embodiment of a system comprising a device 10*a* similar to the one which has just been described in accordance with FIGS. 1A to 1C and a container 100*a*. The base 20*a* and the lid 30*a* of the device 10*a* may have a shape that differs slightly from the one described earlier. For example, they may be connected by a hinge 11*a* with an attached hinge pin, rather than the film hinge of the exemplary embodiment of FIGS. 1A-1C. The application member 40*a* may be substantially identical to the one described earlier.

The container 100*a* may, for example, be a bottle containing a relatively large volume of product, for example about 500 ml of a cosmetic product. The device 10*a* may be removably fixed to the bottle 100*a*, for example, being housed in a recess 110 provided in the side wall of the bottle 100*a*, as depicted in FIGS. 2A and 2B. The device 10*a* may be removed from the bottle to allow it to be carried around. Alternatively, the device 10*a* may be clipped onto the bottom of the bottle, rather than the side.

Figure 2D:
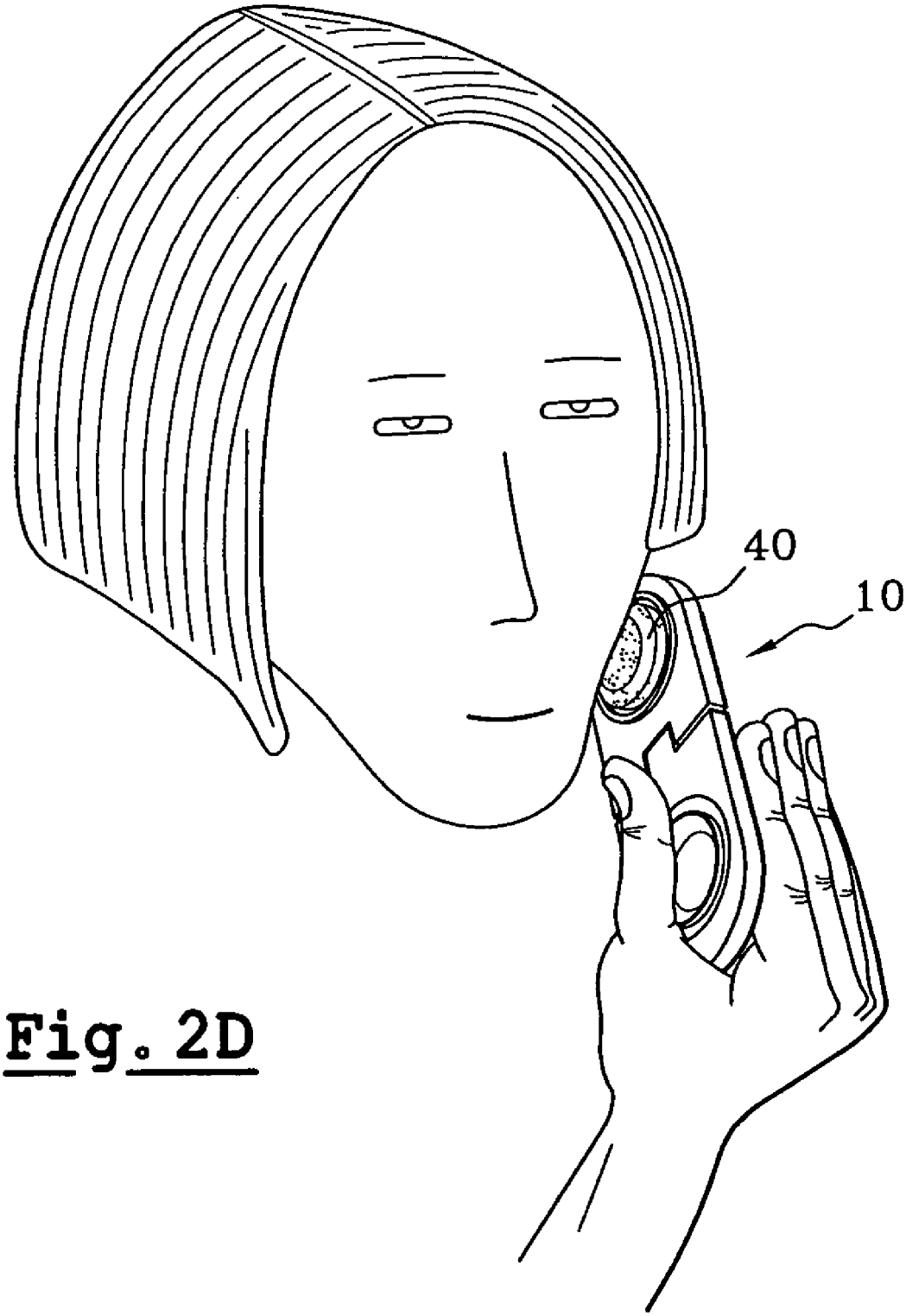
FIG. 2D is a view of the device of FIG. 2C in use for applying product to skin.

To use the system, the user may remove the device 10*a* from the bottle 100*a* and, when the device 10*a* contains no product, the user may fill it by emptying out the product from the bottle 100*a*. The user may fill part of the housing portion 21*a* defining the recess (FIG. 2C) with a quantity of product defined, for example, by marks, not depicted, provided in the housing portion 21*a*. The application member 40*a* may then be impregnated at least partially when the device 10*a* is in the closed position. Here again, if some product remains in the bottom of the housing portion 21*a*, it may be pumped out by the foam application member 40*a* when the device 10*a* is opened. Alternatively (or in addition), the user may impregnate the application member 40*a* with product directly from the bottle 100*a*. The user can then apply the product, for example, to her face or other body part, holding the device 10*a* and bringing the application member 40*a* into contact with a surface, such as, for example, the face, as is shown in FIG. 2D. If desired, the device 10*a* may be filled several times to allow several uses.

FIGS. 3A to 3D depict a device for applying a product according to another exemplary embodiment of the invention. The device 10*b* may comprise a first portion 20*b*, that may be made of a sheet of semi-rigid thermoplastic material, for example. The first portion 20*b* may form a housing portion 21*b* delimiting a recess 22*b*. As an example, the housing portion 21*b* may be formed by a depressed region of the sheet forming the first portion 20*b*. A second portion in the form of a peelable film seal 30*b* may be provided to seal the recess 22*b* closed so as to define a substantially closed reservoir 50*b*. The film seal 30*b* may be, for example, a sheet of a metalloplastic complex, such as for example, a polyethylene terephthalate, polyethylene, aluminum, polyethylene complex.

A foam application member 40*b*, similar to the one described previously with reference to FIGS. 1A to 1C, may be attached to the interior face of the film seal 30*b*. For example, the application member 40*b* may be fixedly attached to the face designed to face the housing portion 21*b*.

The recess 22*b* formed by the housing portion 21*b* may have a shape that substantially complements that of the application member 40*b*. The foam application member 40*b* may be housed in the housing portion 21*b* so as to be in contact with the interior wall of the housing portion 21*b*. The volume defined by the housing portion 21*b* may be slightly smaller than the volume of the application member 40*b* when the application member 40*b* is not compressed. In this manner, in the closed position, the foam application member 40*b* may be slightly compressed inside the housing portion 21*b*, as shown in FIG. 3C.

The application member 40*b* may be welded to the film seal 30*b*. A region of the film seal 30*b* may remain uncovered by the application member 40*b* so as to form a region 32*b* for holding the device 10. The region 32*b* for holding may have an area large enough to permit a user to grasp it, while not being so big that the resulting device formed is too bulky.

The film seal 30*b* may have an area slightly greater than the area of the sheet 20*b* so that it may be grasped with ease and may allow relatively easy opening of the device 10*b*.

Figure 3A:
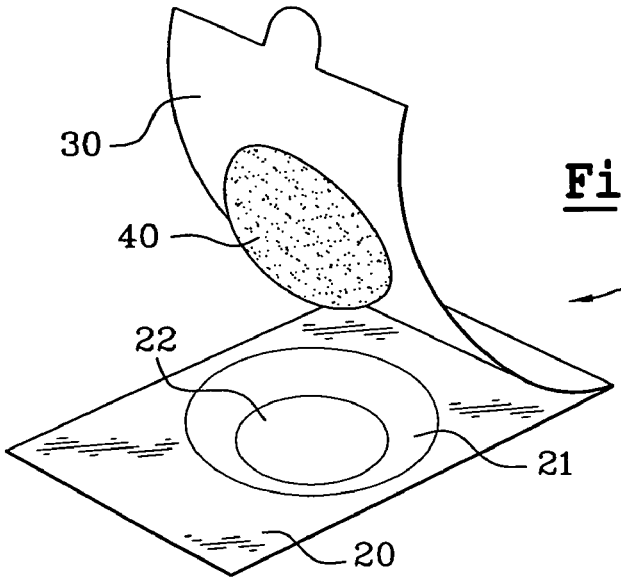
FIG. 3A is a perspective view of yet another exemplary embodiment of a device for applying a product according to an aspect of the invention.
Figure 3B:
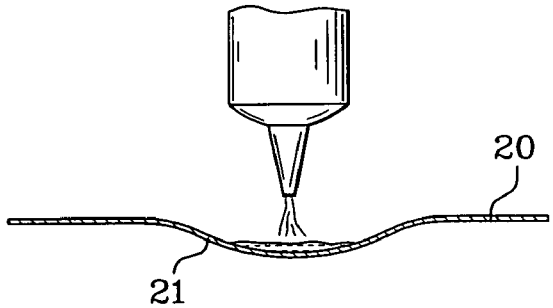
FIG. 3B is a side view of an exemplary embodiment of a stage for making the device of FIG. 3A.
Figure 3C:
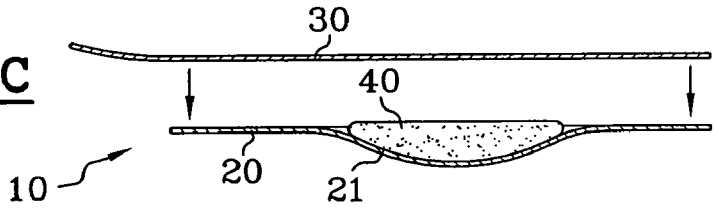
FIG. 3C is a side view of an exemplary embodiment of another stage for making the device of FIG. 3A.
Figure 3D:
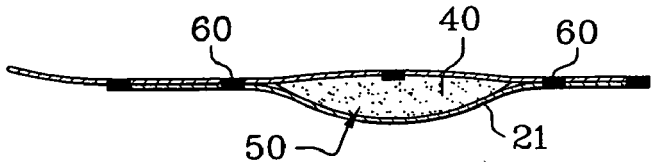
FIG. 3D is a side view of an exemplary embodiment of yet another stage for making the device of FIG. 3A.

To form the device 10*b* of FIG. 3A, the sheet 20*b* and the film seal 30*b* may first be formed separately. A product, such as a cosmetic product, for example, may be introduced into the housing portion 21*b*, as illustrated in FIG. 3B. The application member 40*b* may then be placed on top (FIG. 3C). The foam applicator 40*b* may become impregnated with some of the product. The film seal 30*b* may then be welded via welds 60*b* onto the sheet 20*b* (FIG. 3D), for example by fill welding, substantially all around the application member 40*b*. This may permit a substantially perfect sealing of the device 10*b*. The application member 40*b* also may be welded onto the film seal 30*b*, as shown in FIG. 3D, for example. When the application member 40*b* is welded, it may be slightly compressed so that substantially all the product is soaked into the application member 40*b*. The application member 40*b* also could be welded onto the film seal 30*b* prior to it being placed in the housing portion 21*b* containing the product. In this case, the film seal may then be welded onto the sheet 20*b*.

To use the device 10*b* of FIG. 3D, the user removes the film seal 30*b* to which the application member 40*b* is attached, while the application member 40*b* is loaded with at least substantially all the product. The user may then apply the product to a surface by holding the film seal 30*b* by the region 32*b* and contacting the loaded application member 40*b* with the surface. The flexibility of the film seal 30*b* may allow for relatively convenient and gentle application of the product. As an example, the opening of the device 10*b* may be irreversible, i.e., the device 10*b* may be suitable for only a single use.

Figure 4:
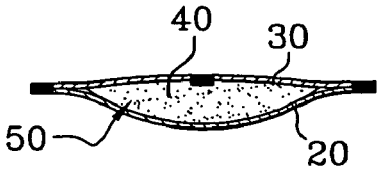
FIG. 4 is a cross-sectional side view of yet another exemplary embodiment of a device for applying product according to an aspect of the invention.

According to a yet another exemplary embodiment depicted in FIG. 4, a device 10*c* for applying a product is substantially in the form of a sachet formed by two sheets 20*c* and 30*c* which are practically identical. Each sheet 20*c*, 30*c* may comprise, for example, a layer of metallic material and a layer of thermoplastic material. The two sheets may be superposed and welded together around their respective peripheral regions to form a sachet delimiting a substantially closed reservoir 50*c*.

An application member 40*c*, like the ones described previously, may be welded onto the interior wall of one of the sheets and may be compressed slightly inside the substantially closed reservoir 50*c* when the two sheets 20*c*, 30*c* are welded together. According to this embodiment, the application member may be loaded with product after it has been welded onto a first sheet and after the second sheet is welded onto the first.

In the exemplary embodiments shown in FIGS. 1A-1C, 2A-2D, 3A-3D, and 4, the application member is depicted as having a substantially circular cross-section. The application member also could have a cross-section of a different shape, for example a square, rectangular, triangular, oval, teardrop, or other similar shape, without going beyond the scope of the present invention. It may also have an oblong shape. Likewise, the device as a whole may have a square, rectangular, triangular, circular, oval, teardrop, or similar cross-section.

Figure 5:
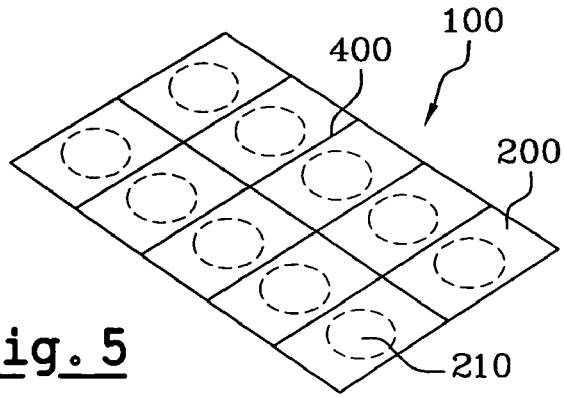
FIG. 5 is a perspective view of an exemplary embodiment of a system for applying a product according to an aspect of the invention.

FIG. 5 depicts yet another exemplary embodiment of the invention whereby there is a system formed of a number of applicator devices. The system may comprise, for example, a sheet 200 of thermoplastic material, in which a number of housing portions 210 are produced by thermoforming. A film seal 300 similar, for example, to the one described for the exemplary embodiment of FIGS. 3A to 3D, may cover the entire sheet so as to seal the housing portions 210 closed. The film seal 300 may be thermally welded to the sheet around each housing. Application members (not shown) may be welded onto the film seal 300 and may be housed in the housing portions 210.

The base sheet 200 may be pre-cut along lines 400 of pre-cutting, arranged around each housing portion 210 so that each housing portion 210 with its corresponding application member and sealed closed by part of the film seal 300, can be separated from the remainder of the sheet. The lines of pre-cutting 400 may be obtained at the time of molding or may be produced after molding using an appropriate tool. This exemplary embodiment may be manufactured in the way indicated with reference to FIGS. 3B-3D.

In an alternative, the system may comprise several sachets like the one described in accordance with FIG. 4.

The devices have been described as containing a care, make-up, and/or other cosmetic products, and being used for application of the same. However, in its broadest aspects, the present invention could be used to store and dispense many other types of substances intended for application to a surface, including, for example, shoe and furniture polishes. Furthermore, sizes and shapes of various structural parts and materials used to make these parts are illustrative and exemplary only and one of ordinary skill in the art would recognize that these materials and sizes can be changed as necessary to produce different effects or desired characteristics of the dispensing assembly.

It will be apparent to those skilled in the art that various modifications and variations can be made to the structure and methodology. Thus, it should be understood that the invention is not limited to the examples discussed in the specification. Rather, the present invention is intended to cover modifications and variations.

What is claimed is:

1. A device for applying a product, the device comprising:

a first portion defining a recess;

a second portion moveable with respect to the first portion so as to selectively place the device in one of a closed position and an open position, wherein the first portion and the second portion define a substantially closed reservoir when the device is in the closed position; and an application member attached to the second portion, the application member being at least partially compressible and configured such that, when the device is in the closed position, the application member is at least partially compressed inside the substantially closed reservoir and, when the device is moved from the closed position to the open position, the application member becomes substantially uncompressed, wherein the application member is configured so that when the application member is uncompressed, the application member is capable of being loaded with substantially all of an amount of product that the device is capable of containing;

wherein the first portion comprises a base and the second portion comprises a lid, wherein both the base and the lid are rigid;

wherein the base is connected to the lid via a hinge; and wherein two mutually cooperating clasp members are provided respectively on the base and the lid, the clasp members being configured to, on the one hand, maintain the device in the closed position and, on the other hand, allow the device to be placed in the open position so as to permit access to the recess.

2. The device of claim 1, wherein the application member is attached to the second portion by at least one of bonding, welding and clipping.

3. The device of claim 1, wherein the application member comprises a compressible porous material.

4. The device of claim 3, wherein the porous material is one of hydrophilic and lipophilic.

5. The device of claim 1, wherein the application member is made of at least one of an open-cell foam, a semi-open-cell foam, a felt, and a frit.

6. The device of claim 1, wherein the application member comprises an additive capable of absorbing at least one of water and oil.

7. The device of claim 1, wherein the application member comprises a preservative.

8. The device of claim 1, wherein the first portion is one of pressed, thermoformed, and injection molded.

9. The device of claim 1, further comprising a cosmetic product contained in the substantially closed reservoir when the device is in the closed position, wherein the cosmetic product is chosen from a make-up and a care product.

10. The device of claim 9, wherein the product is intended for application to at least one of skin, hair, a fingernail, and a toenail.

11. The device of claim 9, wherein the product comprises one of a liquid, a gel, a cream, and a powder.

12. A method for applying a product to a surface, the method comprising:

providing the device of claim 1, wherein the device contains a product intended to be applied to a surface;

moving the device from the closed position to the open position; and placing the application member in contact with the surface so as to apply product loaded on the application member to the surface.

13. The method of claim 12, wherein the product is a cosmetic product.

14. The method of claim 13, wherein the cosmetic product is chosen from a make-up product and a care product.

15. The method of claim 14, wherein the product comprises one of a liquid, a gel, a cream, and a powder.

16. The method of claim 14, wherein the placing of the application member in contact with the surface comprises placing the application member in contact with one of hair, skin, a fingernail, and a toenail.

17. A device for applying a product, the device comprising:

a first portion comprising an impermeable surface, the first portion defining a recess;

a second portion moveable with respect to the first portion so as to selectively place the device in one of a closed position and an open position, wherein, in the closed position, the recess of the first portion and the second portion define a substantially closed reservoir, the substantially closed reservoir containing a cosmetic product intended for application to a surface; and an application member attached to the second portion, the application member being at least partially compressible and configured to be in contact with the impermeable surface and at least partially compressed inside the substantially closed reservoir when the device is in the closed position;

wherein the first portion comprises a base and the second portion comprises a lid, wherein both the base and the lid are rigid;

wherein the base is connected to the lid via a hinge; and wherein two mutually cooperating clasp members are provided respectively on the base and the lid, the clasp members being configured to, on the one hand, maintain the device in the closed position and, on the other hand, allow the device to be placed in the open position so as to permit access to the recess.

18. The device of claim 17, wherein, when the device is moved from the closed position to the open position, the application member becomes substantially uncompressed.

19. The device of claim 18, wherein the application member is configured to absorb substantially all of the product contained in the reservoir.

20. The device of claim 17, wherein the application member comprises a compressible porous material.

21. The device of claim 20, wherein the porous material is one of hydrophilic and lipophilic.

22. The device of claim 17, wherein the application member is made of at least one of an open-cell foam, a semi-open-cell foam, a felt, and a frit.

23. The device of claim 17, wherein the application member comprises an additive capable of absorbing at least one of water and oil.

24. The device of claim 17, wherein the application member comprises a preservative.

25. The device of claim 17, wherein the cosmetic product is chosen from a make-up product and a care product.

26. The device of claim 17, wherein the cosmetic product is intended for application to at least one of skin, hair, a fingernail, and a toenail.

27. The device of claim 17, wherein the cosmetic product comprises one of a liquid, a gel, a cream, and a powder.

28. A method for applying a product to a surface, the method comprising:

providing the device of claim 17;

moving the device from the closed position to the open position; and placing the application member in contact with the surface so as to apply at least some of the product to the surface.

29. The method of claim 28, wherein the placing of the application member in contact with the surface comprises placing the application member in contact with one of hair, skin, a fingernail, and a toenail.

30. The device of claim 17, wherein the reservoir contains a layer of cosmetic product intended to be applied to a surface, the layer of cosmetic product contacting both the application member and the impermeable surface.

* * * * *